United States Patent [19]

Rasmussen

[11] Patent Number: 4,643,104

[45] Date of Patent: Feb. 17, 1987

[54] ROTATING TRAY ASSEMBLY

[76] Inventor: Svien Rasmussen, 24179 Wright Dr., Hayward, Calif. 94545

[21] Appl. No.: 786,041

[22] Filed: Oct. 10, 1985

[51] Int. Cl.[4] ..... A47B 11/00

[52] U.S. Cl. ..... 108/105; 108/111; 108/144

[58] Field of Search ..... 108/103, 105, 111, 151, 108/60, 61, 144

[56] References Cited

U.S. PATENT DOCUMENTS

| | | | |
|---|---|---|---|
| 128,162 | 6/1872 | Millard | 108/103 |
| 776,232 | 11/1904 | Gehrken | 108/103 |
| 2,158,085 | 5/1939 | Porter | 108/105 |
| 2,915,194 | 12/1959 | Shoffner | 108/144 |
| 3,683,824 | 8/1972 | Weber | 108/151 |
| 3,858,529 | 1/1975 | Salladay | 108/103 |
| 4,026,220 | 5/1977 | Schuring | 108/111 |
| 4,145,977 | 3/1979 | Yellin | 108/111 |
| 4,498,401 | 2/1985 | Hannecke | 108/60 |

FOREIGN PATENT DOCUMENTS

| | | | |
|---|---|---|---|
| 1215475 | 12/1970 | United Kingdom | 108/151 |

*Primary Examiner*—Francis K. Zugel

*Attorney, Agent, or Firm*—Sumner C. Rosenberg; William H. Needle

[57] ABSTRACT

A rotating stacked tray apparatus is disclosed which comprises a base, a lower tray which rotates on the base which accepts a shaft coaxially mounted on the lower tray, which such shaft is used to support one or more upper trays or shelves. The upper trays have central openings which fit around the central shaft. The upper shelves are supported by horizontal support slits in the central shaft and matching extending portion of each shelf. The apparatus in its preferred embodiment, is designed to be packaged unassembled in a flat package and to be assembled without tools.

4 Claims, 7 Drawing Figures

ROTATING TRAY ASSEMBLY

BACKGROUND AND SUMMARY OF THE INVENTION

The present invention relates to improvements in rotating tray assemblies. More specifically, a stackable tray is disclosed which is designed to be packaged in a generally flat manner and to be simply assembled.

Rotating trays, sometimes called lazy-Susans, are known in application to table tops and general storage devices for fitting within semi-enclosed compartments. Multiple shelf rotating trays are also known. However, prior art multiple shelf rotating trays generally either require substantial assembly or come preassembled in packages which, consequently, occupy a large volume. Assembly of such devices in inconvenient for the consumer. Preassembled assemblies require expensive shipping, storage and shelf space. Furthermore, prior art multiple shelf rotating trays do not provide the flexibility of easily adjustable shelves.

The present invention is a rotating multiple shelf rotating tray which comprises a base upon which is mounted a lower tray, which rotates on the base by conventional means. A shaft assembly is mounted on the center of the lower tray for supporting one or more shelves above the base. The shaft itself also provides a central enclosure area which may be optionally covered with a lid. The central shaft may comprise a generally rectangular flexible element which may be formed into the shaft by connecting two opposite edges. The shelves have an opening in the center for fitting over and around the shaft and are mounted by being supported at specific and desired heights along said shaft.

Preferably, the main elements of the invention are formed of plastic for the necessary flexibility and durability. Furthermore, the shaft elements is formed of a series of connected arc portions which are relatively thick in the arc portions and relatively thin where the arcs join, so that the shaft element may be flexibly bent in the horizontal direction while providing a vertically rigid shaft. Further, the shape of the shelf openings is matched to the shaft shape, which is a series of undulating arcs. Slits are located in the arc portions of the shaft at desired heights, into which the apexes of the shelf may then be twisted to support the shelf.

Therefore, it is an object of the invention to provide a multiple shelf rotatable tray assembly which, in its unassembled state, may be compactly packaged.

It is a further object of the present invention to provide such a tray assembly which may be simply assembled with no tools.

It is a still further object of this invention to provide such a tray assembly which is inexpensive in construction.

It is yet another object of the invention to provide a rotatable tray assembly with adjustable height shelves.

These and other objects and advantages will appear from the following description with reference to the drawings.

DESCRIPTION OF THE PREFERRED EMBODIMENT

The preferred embodiment is now described with reference to the drawings, in which like numbers indicate like parts throughout the view.

Figure 1:
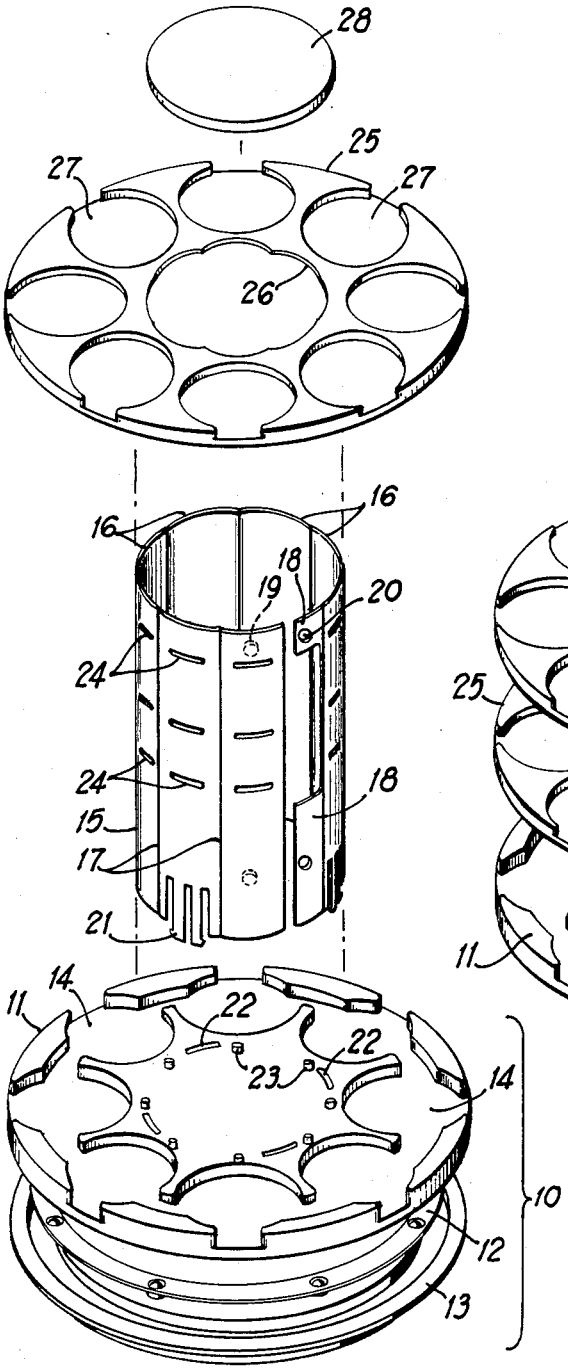
FIG. 1 is an exploded perspective view of the rotating tray assembly.

FIG. 1 shows the elements of the invention intended as a kitchen utility tray, such as a spice rack. The rotating lower tray base assembly 10 comprises a lower tray 11 mounted on a ball bearing ring 12 and an outer ball race ring 13 which is the base of the unit. The lower tray has recesses 14 around its circumference for retaining objects, such as bottles, placed on the tray.

A shaft 15 is formed from a generally rectangular flexible element comprised of a series of arcs 16 connected at flexible joint areas 17. The shaft may be made of plastic in one-piece construction, with the arc portions 16 relatively thick and the joint areas 17 relatively thin. The flexible element may be packaged in its generally flat configuration and then assembled by bringing the edges of the two arcs at either end of the element together to form the shaft. Extensions 18 are provided on one arc edge to provide connection means with the opposite edge by means of snap connectors 19 on the back of the element which mate with holes 20 in the extensions 18. The individual arcs of the shelf elements have the same dimensions, with the radius of each individual arc smaller than the radius of the shaft, such that the assembled shaft presents an undulating outside surface.

Additionally, tab extensions 21 are formed in the bottom of the shaft for mating in locking relationship with slots 22 in the lower tray. The lower tray also has protrusions 23 which act as guides against the bottom of the shaft when it is assembled to the lower tray (as can be more clearly seen in FIG. 2) in the joint areas 17, to maintain additional support for the bottom of the shaft.

The shaft also has a series of horizontal slits 24 through the arc surfaces at various heights at which shelves may be supported. These will be described in more detail below.

At least one upper shelf 25 fits around the shaft 15. The opening 26 in the shelf 25 has about the same shape and dimensions as the outer surface of the shaft 15. Thus, each shelf may slide up and down the shaft when the opening is aligned with the shaft and may be locked in position at the height of any series of slits as described below in conjunction with FIGS. 3 and 4. The shelf also may have recesses 27 for the purpose of holding in place items placed on the shelf.

A lid 28 is provided to serve as a cover of the shaft. Thus, the inside of the shaft may be used to store other items as desired.

Figure 2:
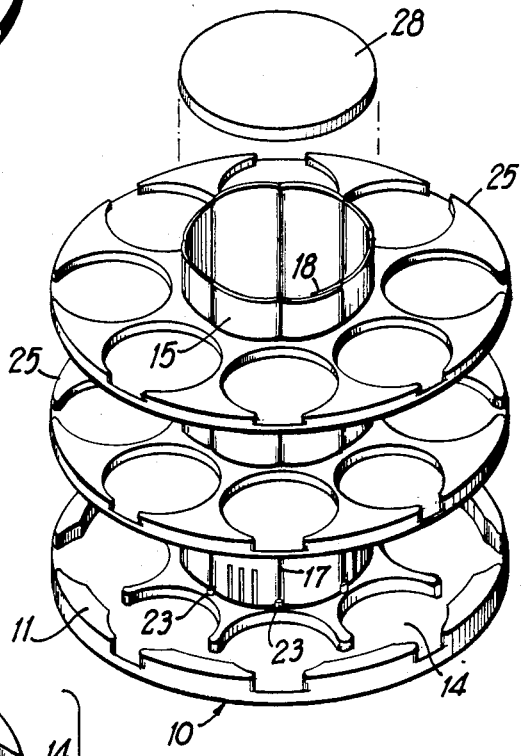
FIG. 2 is a perspective view of a partially assembled rotating tray.

FIG. 2 shows the rotating tray in partially assembled form. The shaft 15 is itself assembled, and it can be seen that the extension 18 overlaps on the inside of the shaft where its connection is made. The shaft 15 is also installed into the lower tray 11. Two shelves 25 are shown around the shaft in unsupported orientation to the shaft such that the shelves may be slidably adjusted upward or downward. The lid 28 may be placed on the shaft after the shelves are placed on the shaft.

Figure 3:
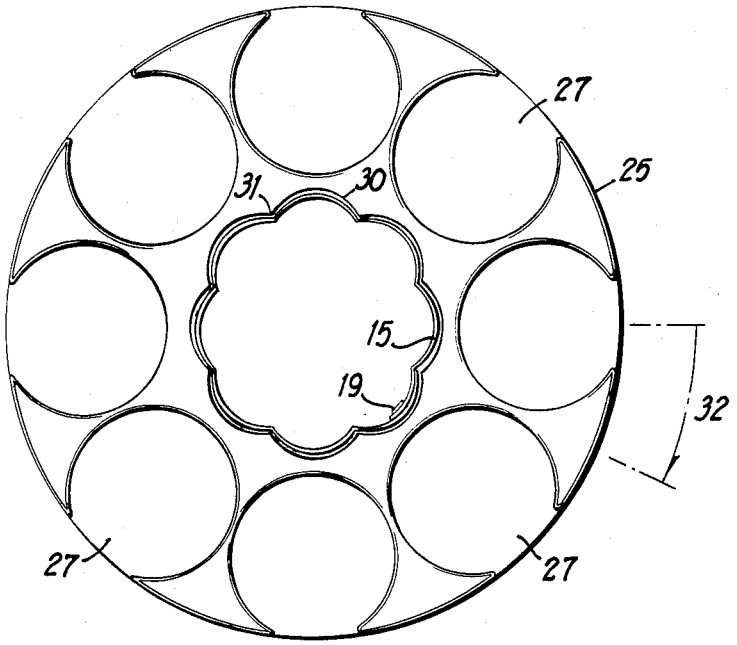
FIG. 3 is a top view of the rotating tray with an upper shelf in an unlocked position.
Figure 4:
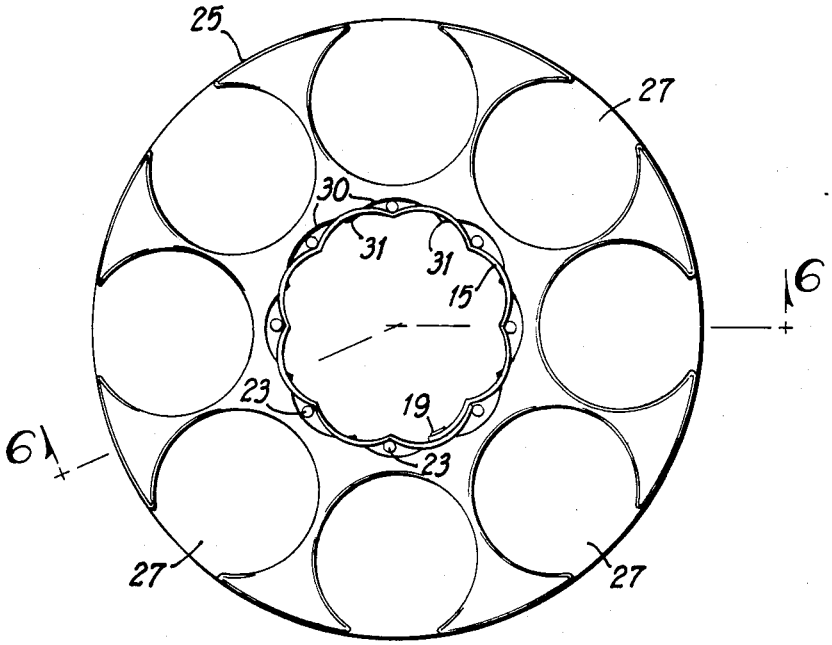
FIG. 4 is a top view of the rotating tray with an upper shelf in a locked position.

FIGS. 3 and 4 show the means by which a shelf is supported on the shaft. In this embodiment, the shaft 15 forms an eight arc surface and the shelf 25 has a complementarily shaped inside opening of arcs 30 which join at apex points 31. As shown in FIG. 1, horizontal slits 24 are cut in all arc surfaces of the shaft 15 at various levels. Thus, in FIG. 1 three different levels appear. For each level the slits 24 are in a horizontal plane to support a shelf by the area around its apex points 31. The slits should be centered on each arc of the shaft and the width of the slit should define an angle with respect to the axis of the shaft of approximately half of the angle defined by one arc of the shaft. In order to install a shelf 25, it is slid down the shaft to the level of the described set of slits 24, and is rotated with respect to the shaft by an angle 32 which is half of the angle of one arc of the shaft.

FIG. 4 shows the shelf 25 in the twisted support relationship with the shaft 15. In twisting the shelf, the apex points 31 will necessarily be resisted by the shaft prior to the apex points entering the slits 24. However, the shaft is to be sufficiently flexible that the shelves may be installed in or removed from the slit supports with moderate force. When the shelf is in the installed position of FIG. 4, the slits ends will be just adjacent to the arc 30 defining the inside opening 26 of the shelf, so that the shelf will be supported vertically and will not rotate with respect to the shaft.

Figure 5:
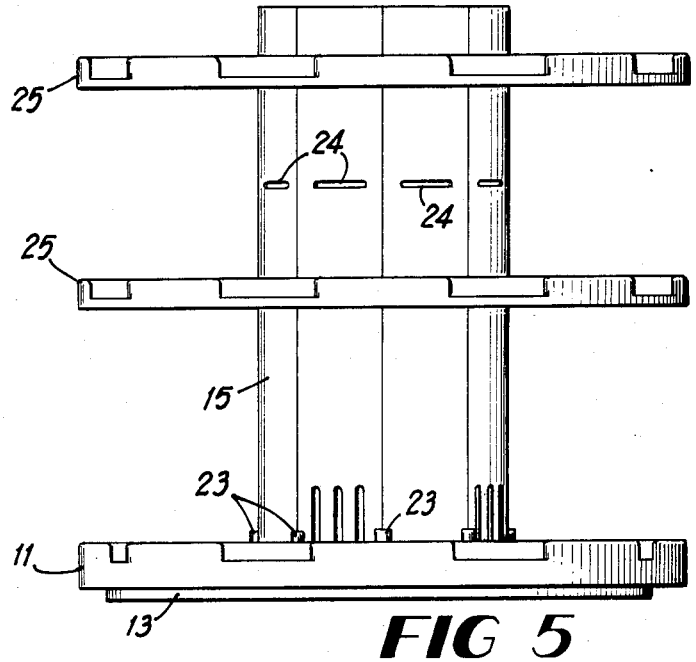
FIG. 5 is a side view of the rotating tray.

FIG. 5 is a side view of the assembled rotational tray with two shelves 25 mounted upon the shaft 15.

Figure 6:
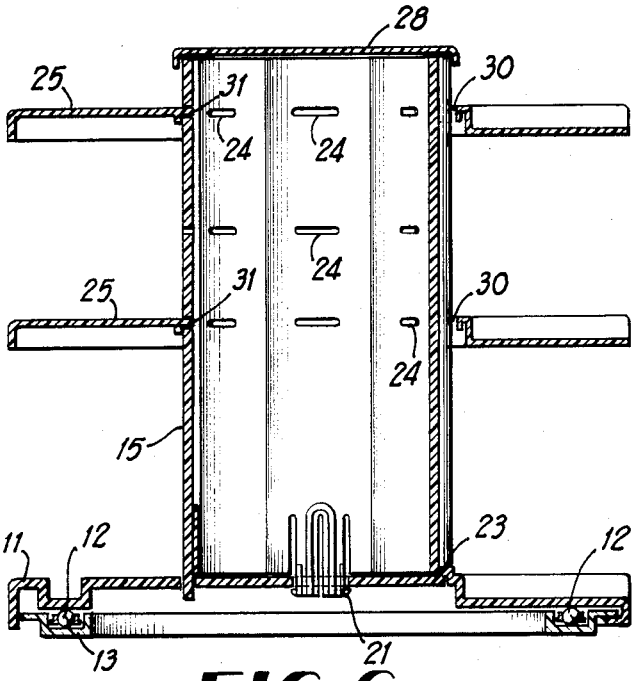
FIG. 6 is a section of the rotating tray along line 6—6 of FIG. 4.
Figure 7:
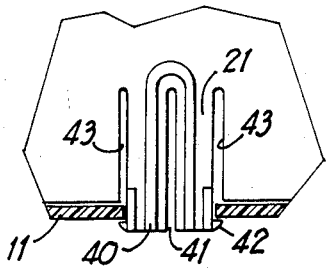
FIG. 7 is a cut-away view in magnified partial section of the tab and slot connection of the shaft to the base.

FIG. 6 is a section view of the apparatus along ling 6—6 of FIG. 4. This view shows clearly how the shelf 25 is supported around its apex areas 31 which fit into the slits 24 through the shaft. The locking tab 21 is shown and is magnified in FIG. 7. The tab entension comprises two legs 40 which extend beyond the end of the shaft is formed by cutting outer notches 43 and a central notch 41 into the shaft which allows the legs to be resiliently pinched together. The opening 22 in the lower tray 11 is approximately the equal to the width of the legs. Tapered teeth 42 on the outside of each leg force the legs together when inserted into the opening 22 and then securely lock the legs in position once the teeth pass all the way through the opening.

While the invention has been described in detail with particular reference to the preferred embodiment thereof, it will be understood that variations and modifications can be effected within the spirit and scope of the invention as previously described and as defined by the claims.

What is claimed is:

1. A rotating stacked tray apparatus comprising;

a base;

a generally circular lower tray rotatably mounted on said base for rotating around its axis;

a shaft coaxially mounted on said lower tray which comprises a generally rectangular flexible element, having a series of connected arc portions wherein the arc portions are generally inflexible and the arc connections are flexible, such that the shaft formed thereby has an undulating arc surface, and having connection means on opposing edges, such that said shaft is formed when said opposing edges are brought together and connected;

and at least one generally circular shelf having a central opening for receiving said shaft and supported along the height of said shaft, wherein the central opening of said at least one shelf has complementary shape with said shaft, such that said opening is a series of arcs meeting at apexes around said opening, wherein said at least one shelf is supported by said shaft by means comprising horizontal slits centered on each of the arc portions of said shaft in the same plane, said slits having generally the same width as said shelf, and the length of said slits being such that the apexes of the opening of said shelf may be securely received within said slits when said shelf is rotated around the axis of said shaft in the plane of said slits.

2. The apparatus of claim 1, wherein said at least one shelf may be adjustably supported at a plurality of heights along said shaft.

3. The apparatus of claim 1, which further comprises a lid which fits over the open top of said shaft, thereby forming an enclosed central compartment of said apparatus.

4. The apparatus of claim 1, wherein said shaft is mounted to said lower tray by means of a plurality of tabs extending from the bottom of said shaft which mate within matching slots in said lower tray in locking relationship therewith.

* * * * *